US009976422B2

(12) United States Patent
Fishler

(10) Patent No.: US 9,976,422 B2
(45) Date of Patent: May 22, 2018

(54) VARIABLE SPAN SPLITTER BLADE

(71) Applicant: UNITED TECHNOLOGIES CORPORATION, Farmington, CT (US)

(72) Inventor: Benjamin E. Fishler, San Diego, CA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 461 days.

(21) Appl. No.: 14/768,964

(22) PCT Filed: Dec. 31, 2013

(86) PCT No.: PCT/US2013/078444
§ 371 (c)(1),
(2) Date: Aug. 19, 2015

(87) PCT Pub. No.: WO2014/158285
PCT Pub. Date: Oct. 2, 2014

(65) Prior Publication Data

US 2016/0003050 A1 Jan. 7, 2016

Related U.S. Application Data

(60) Provisional application No. 61/769,466, filed on Feb. 26, 2013.

(51) Int. Cl.
*F01D 5/14* (2006.01)
*F01D 5/04* (2006.01)
(Continued)

(52) U.S. Cl.
CPC ..... *F01D 5/146* (2013.01); *F01D 5/02* (2013.01); *F01D 5/048* (2013.01);
(Continued)

(58) Field of Classification Search
CPC ..... F04D 29/68; F04D 29/681; F04D 29/685; F04D 29/2272; F04D 29/284;
(Continued)

(56) References Cited

U.S. PATENT DOCUMENTS 4,195,473 A * 4/1980 Aspinwall ..... F01D 5/048 415/143
5,002,461 A 3/1991 Young et al.
(Continued)

FOREIGN PATENT DOCUMENTS

EP 2428684 A1 3/2012
JP 2009228549 A * 10/2009
(Continued)

OTHER PUBLICATIONS

Korean Intellectual Property Office, International Application Division, International Search Report, dated Oct. 21, 2014 for PCT/US2013/078444.
(Continued)

*Primary Examiner* — Mark Laurenzi
*Assistant Examiner* — Xiaoting Hu
(74) *Attorney, Agent, or Firm* — Cantor Colburn LLP

(57) ABSTRACT

The presently disclosed embodiments utilize flow from a higher-energy portion of flow within the impeller flow path and inject it into the lower-energy portion of the flow path to re-energize the flow, delaying the onset of, or minimizing, large (and inefficient, entropy-generating) re-circulation zones in the flow field. By making a spanwise cut along the chord length of the splitter blade (variable blade clearance from leading edge to trailing edge), additional secondary flow occurs within the flow passages as the higher pressure flow on the pressure side of the blade can now spill over into the low-pressure suction side of the blade.

14 Claims, 8 Drawing Sheets

(51) Int. Cl.

| | |
|---|---|
| ***F04D 29/24*** | (2006.01) |
| ***F04D 29/30*** | (2006.01) |
| ***F04D 29/66*** | (2006.01) |
| ***F04D 29/22*** | (2006.01) |
| ***F04D 29/28*** | (2006.01) |
| ***F04D 29/68*** | (2006.01) |
| ***F01D 5/02*** | (2006.01) |

(52) U.S. Cl.
CPC ..... *F04D 29/2272* (2013.01); *F04D 29/24* (2013.01); *F04D 29/242* (2013.01); *F04D 29/245* (2013.01); *F04D 29/284* (2013.01); *F04D 29/30* (2013.01); *F04D 29/666* (2013.01); *F04D 29/681* (2013.01); *F05D 2220/32* (2013.01); *F05D 2250/90* (2013.01)

(58) Field of Classification Search
CPC ..... F04D 29/30; F04D 29/24; F04D 29/242; F04D 29/245; F04D 29/666; F05D 2250/90; F01D 5/02; F01D 5/048; F01D 5/146
See application file for complete search history.

(56) References Cited

U.S. PATENT DOCUMENTS

| | | | | |
|---|---|---|---|---|
| 5,263,816 | A | 11/1993 | Weimer et al. | |
| 6,273,671 | B1 | 8/2001 | Ress, Jr. | |
| 7,758,306 | B2 | 7/2010 | Burton et al. | |
| 2002/0174657 | A1 | 11/2002 | Rice et al. | |
| 2007/0059179 | A1* | 3/2007 | Xu | F04D 29/284 416/182 |
| 2008/0148564 | A1 | 6/2008 | Burton | |

FOREIGN PATENT DOCUMENTS

| | | | | |
|---|---|---|---|---|
| KR | 20110083363 | A | * | 7/2011 |
| KR | 1020110106946 | A | | 1/2014 |

OTHER PUBLICATIONS

Korean Intellectual Property Office, International Application Division, Written Opinion of International Searching Authority, dated Oct. 21, 2014 for PCT/US2013/078444.

"Research on Transonic Centrifugal Compressor Blades Tip Clearance Distribution of Vehicle Turbocharger"; G. Guo et al., SAE International Journal Fuels and Lubricants, vol. 1, No. 1, Jun. 26, 2008, pp. 1187-1194, XPO55252163 (9 pp).

"Theoretical Evaluation of Flow through a Mixed flow Compressor Stage"; S. Rammamurthy et al., XIX International Symposium on Air Breathing Engines 2009, vol. 1, Sep. 11, 2009, pp. 410-419, XP055252131 (9 pp).

European Office Action for Application No. EP13879947.3-1610 dated Sep. 28, 2017 (5 pp).

European Search Report for Application No. EP13879947 dated Jun. 7, 2016 (9 pp).

* cited by examiner

VARIABLE SPAN SPLITTER BLADE

CROSS-REFERENCE TO RELATED APPLICATIONS

The present application is a national stage of and claims the priority benefit of PCT Application Serial No. PCT/US2013/078444, filed Dec. 31, 2013, which claims the priority benefit of U.S. Patent Application Ser. No. 61/769,466 filed Feb. 26, 2013, the text and drawings of which are hereby incorporated by reference in their entireties.

TECHNICAL FIELD OF THE DISCLOSURE

The present disclosure generally related to gas turbine engines and, more specifically, to compressor splitter blades in a gas turbine engine.

BACKGROUND OF THE DISCLOSURE

Improvement of the efficiency of a compressor stage in a gas turbine engine can be accomplished by improving the efficiency of either the impeller, diffuser, and/or deswirl components to improve the overall total-to-total efficiency of the system. Splitter blades/vanes (impellers/diffusers) are used for increasing the performance characteristics of a compressor stage component in a gas turbine engine by preventing/minimizing flow separation through the flow passage with less blockage and less blade surface area than increasing the blade count of the "main" blades. Even so, flow separation still occurs within the flow passage due to an adverse pressure gradient: the flow is slowed down with increasing streamwise distance to the point of stopping, followed by flow reversal, separation and recirculation.

Therefore, improvements in the compressor stage of a gas turbine engine are still needed to minimize or prevent flow separation within the flow passage and increase the efficiency of the compressor stage. The presently disclosed embodiments are directed to this need.

SUMMARY OF THE DISCLOSURE

The presently disclosed embodiments utilize flow from a higher-energy portion of flow within the impeller flow path and inject it into the lower-energy portion of the flow path to re-energize the flow, delaying the onset of, or minimizing, large (and inefficient, entropy-generating) re-circulation zones in the flow field. By making a spanwise cut along the chord length of the splitter blade (variable blade clearance from leading edge to trailing edge), additional secondary flow occurs within the flow passages as the higher pressure flow on the pressure side of the blade can now spill over into the low-pressure suction side of the blade.

In one embodiment, a compressor for a gas turbine engine is disclosed, the compressor comprising: a flow passage shroud; and a splitter blade disposed adjacent the flow passage shroud, wherein the splitter blade includes a leading edge, a trailing edge, and a chord length; wherein a clearance between the splitter blade and the flow passage shroud is variable along the chord length of the splitter blade.

In another embodiment, a gas turbine engine is disclosed, comprising: a flow passage shroud; and a compressor, the compressor comprising: a flow passage hub; and a splitter blade coupled to the flow passage hub and disposed adjacent the flow passage shroud, wherein the splitter blade includes a leading edge, a trailing edge, and a chord length; wherein a clearance between the splitter blade and the flow passage shroud is variable along the chord length of the splitter blade.

In another embodiment, a method of increasing an efficiency of a gas turbine compressor having a splitter blade disposed in a flow passage with a gas flow therein is disclosed, the method comprising the step of: a) causing a portion of the gas flow on a high pressure side of the splitter blade to flow to a low pressure side of the splitter blade in order to prevent entropy-generating recirculation zones on the low pressure side of the splitter blade.

Other embodiments are also disclosed.

DETAILED DESCRIPTION OF THE DISCLOSED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
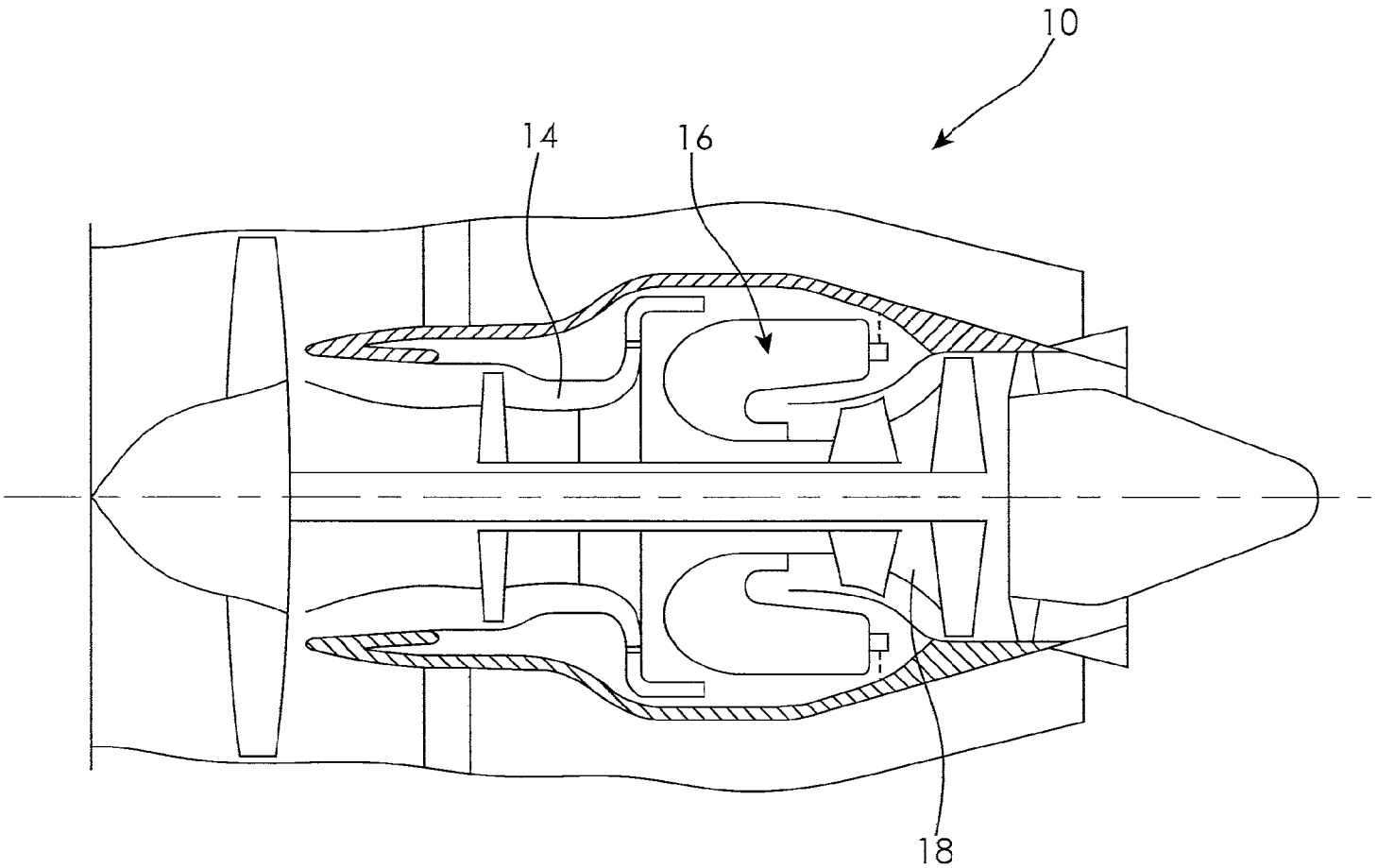
FIG. 1 is a schematic cross-sectional diagram of an embodiment of a gas turbine engine in an embodiment.

FIG. 1 illustrates a gas turbine engine 10, generally comprising in serial flow communication a compressor section 14 for pressurizing the air, a combustor 16 in which the compressed air is mixed with fuel and ignited for generating an annular stream of hot combustion gases, and a turbine section 18 for extracting energy from the combustion gases.

The flow passage (or flow path) of the compressor section 14 is defined as the passage bounded by the hub and shroud, with the gas entering the flow passage at an inlet and leaving at an outlet/exit. As discussed above, splitter blades/vanes (impellers/diffusers) are used for increasing the performance characteristics of a compressor stage component in a gas turbine engine by preventing/minimizing flow separation of the gas flow through the flow passage with less blockage and less blade surface area than increasing the blade count of the "main" blades. Even so, flow separation (when gas flowing along a surface ceases to flow parallel to the surface but instead flows over a near-stagnant bubble) still occurs within the flow passage due to an adverse pressure gradient: the gas flow relative velocity is slowed down with increasing streamwise distance to the point of stopping (zero relative velocity), followed by flow reversal (negative relative velocity in the positive streamwise direction), causing separation of gas from the main flow, and recirculation of the separated gas. In the compressor, the low-pressure side of the splitter blade has been identified as an area where the localized flow significantly slows down to the point of separation from the main flow, which then begins to disrupt the other regions of the flow-field, propagating lower velocity flow towards the pressure side of the main blade. The re-circulation zone (which is an area of the flow that does not follow the passage defined by the main blade and the adjacent splitter blade) increases the entropy, thereby decreasing the efficiency.

The presently disclosed embodiments allow the higher-energy flow to spill over the splitter blade and add extra energy to the low Mach number/recirculating/entropy-generating regions of the flow within the flow passage. Thus, the impeller efficiency is increased, thereby increasing the entire compressor stage efficiency. In addition, there are structural benefits to cutting the splitter blade further away from the engine shroud side, since in areas where there is a bleed port on the shroud, the greater the distance between the splitter blade and the bleed port, the less violent the interaction and resulting pressure perturbations are. Additionally, there are lower centrifugal forces acting on the splitter blade as there is less mass at a larger radius. As centrifugal acceleration is defined as follows:

$$a_c = \frac{v^2}{r},\ F_c = m * a_c,$$

the force is directly proportional to the acceleration, the acceleration is proportional to velocity squared, and the tangential velocity increases linearly with increasing radius ($v_t = \omega r$). Thus the net result is a linear increase in force experienced with increased radius. In addition, reducing the size of the splitter blade creates weight savings because of the reduction in material. The embodiments disclosed herein therefore increase efficiency, increase structural reliability, and decrease weight.

Figure 2:
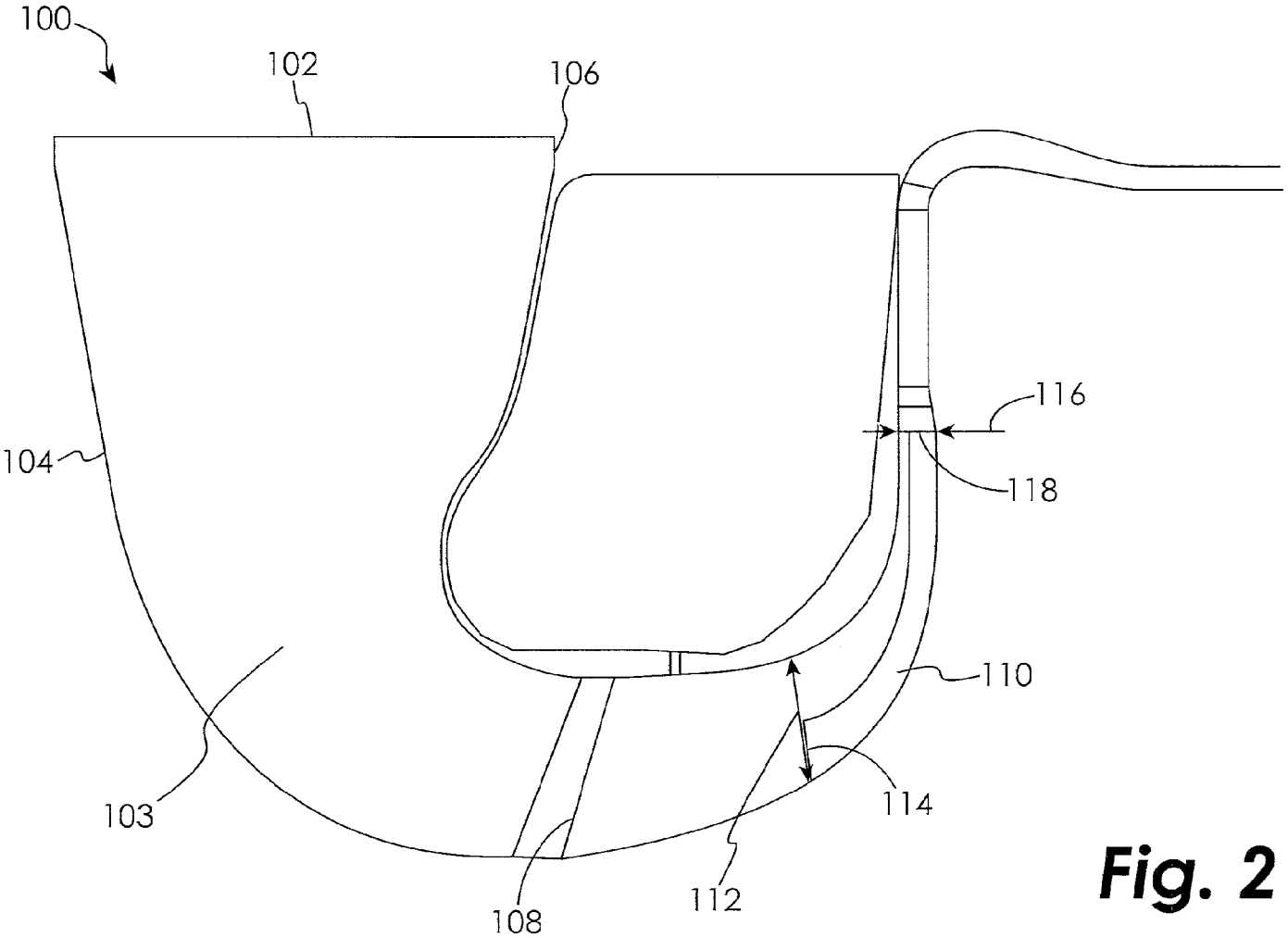
FIG. 2 is a schematic meridional projection of a portion of a gas turbine engine showing a compressor main blade and splitter blade according to one embodiment.

With reference now to FIG. 2, there is illustrated a schematic meridional (axial-radial) projection of a portion of a gas turbine engine showing a compressor blade and splitter blade according to one embodiment, indicated generally at 100. The inlet 102 to a flow passage 103 is formed between the flow passage hub 104 and the flow passage shroud 106. One of the compressor blades 108 is shown in the flow passage. As the blade 108 is coupled to the flow passage hub, there is no gap between the blade 108 and the flow passage hub 104, while a close clearance is maintained between the blade 108 and the flow passage shroud 106. As used herein, the term "coupled" is intended to encompass any type of connection, including items that are coupled by being formed from a unitary piece of material (such as by machining the coupled items from a single billet of metal), items that are welded together, items that are brazed together, or items that are joined together by any other means. Next to the blade 108 in the flow passage 103 is a splitter blade 110 formed according to one embodiment of the present disclosure. As the splitter blade 110 is coupled to the flow passage hub, there is no gap between the splitter blade 110 and the flow passage hub 104, while there is a variable clearance between the splitter blade 110 and the flow passage shroud 106 along the chord length (i.e., the distance between the leading edge and trailing edge) of the splitter blade 110. If the distances between the flow passage 103 inlet and outlet on both the flow passage hub 104 and the flow passage shroud 106 are normalized, "span" may be defined as the distance between the flow passage hub 104 and the flow passage shroud 106 at common normalized increments on the flow passage hub 104 and the flow passage shroud 106. In one embodiment, the clearance between the splitter blade 110 and the flow passage shroud 106 may range from approximately 50% of the span 112 at the location of the leading edge 114 of the splitter blade 110, to approximately the same clearance as the blade 108 at the location of the trailing edge 118 of the splitter blade 110. In another embodiment, the clearance between the splitter blade 110 and the flow passage shroud 106 may range from approximately 10% to <100% of the span 112 at the location of the leading edge 114 of the splitter blade 110, to approximately the same clearance as the blade 108 (typically less than 1.5% of the span) at the location of the trailing edge 118 of the splitter blade 110. In another embodiment, the clearance between the splitter blade 110 and the flow passage shroud 106 may range from approximately the same clearance as the blade 108 at the location of the leading edge 114 of the splitter blade 110, to approximately 10% to <100% of the span 116 at the location of the trailing edge 118 of the splitter blade 110. In other embodiments, the clearance between the splitter blade 110 and the flow passage shroud 106 may range from approximately 10% to <100% of the span 112 at the location of the leading edge 114 of the splitter blade 110, to approximately 10% to <100% of the span 116 at the location of the trailing edge 118 of the splitter blade 110. In the various embodiments, the clearance between the splitter blade 110 and the flow passage shroud 106 along the chord length between the leading edge 114 and the trailing edge 118 of the splitter blade 110 is variable and may exhibit any shape, whether linear, nonlinear, or a combination of linear and nonlinear segments. In a typical prior art compressor, the clearance between the splitter blade and the flow passage shroud is nominally the same as the blade 108 along the entire chord length of the splitter blade.

Figure 3:
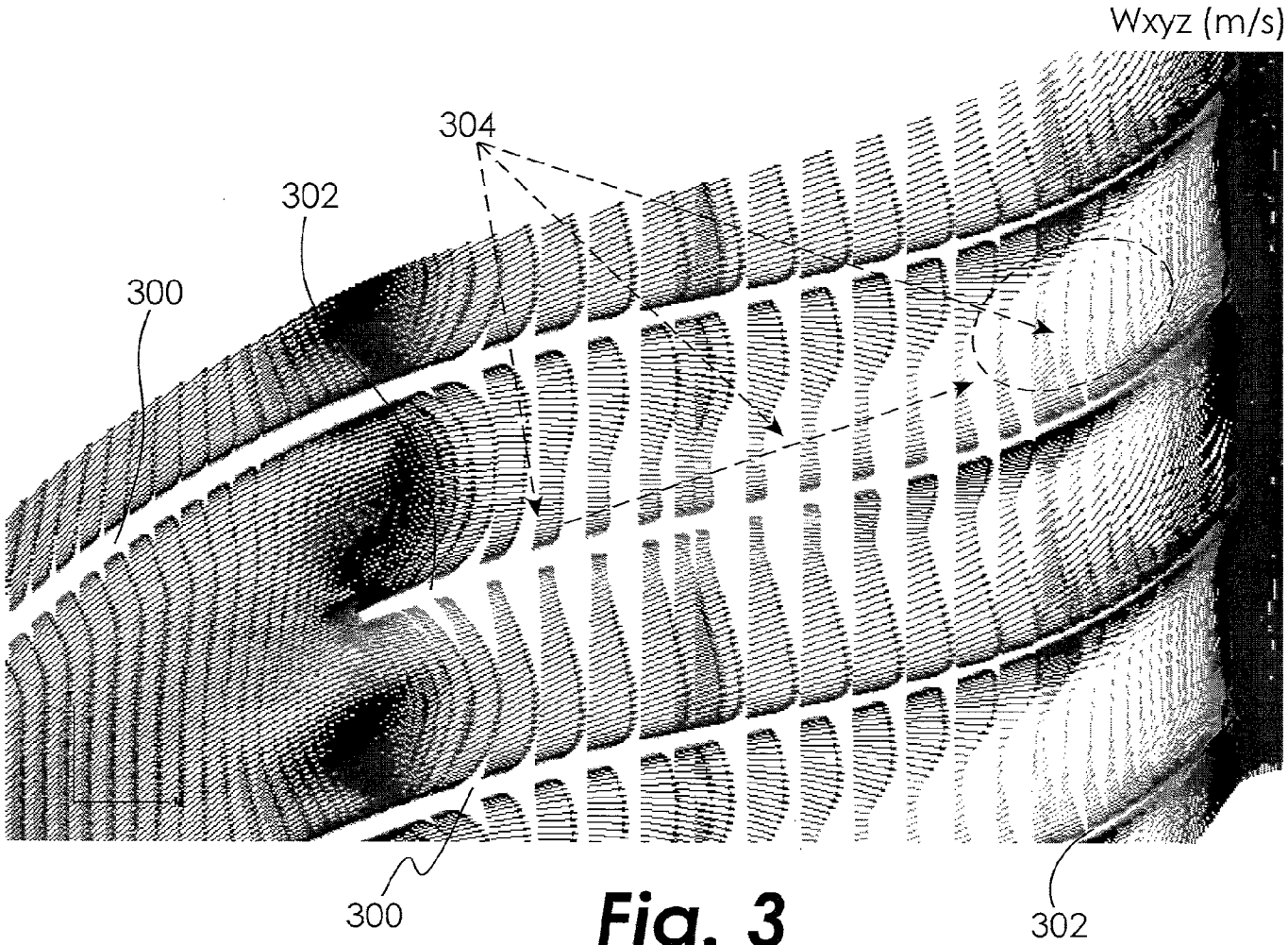
FIG. 3 is a graph of relative velocity vectors (flow velocity relative to the main blade, which is rotating) calculated in a computational fluid dynamics simulation for a compressor section of a gas turbine engine according to an embodiment.
Figure 4:
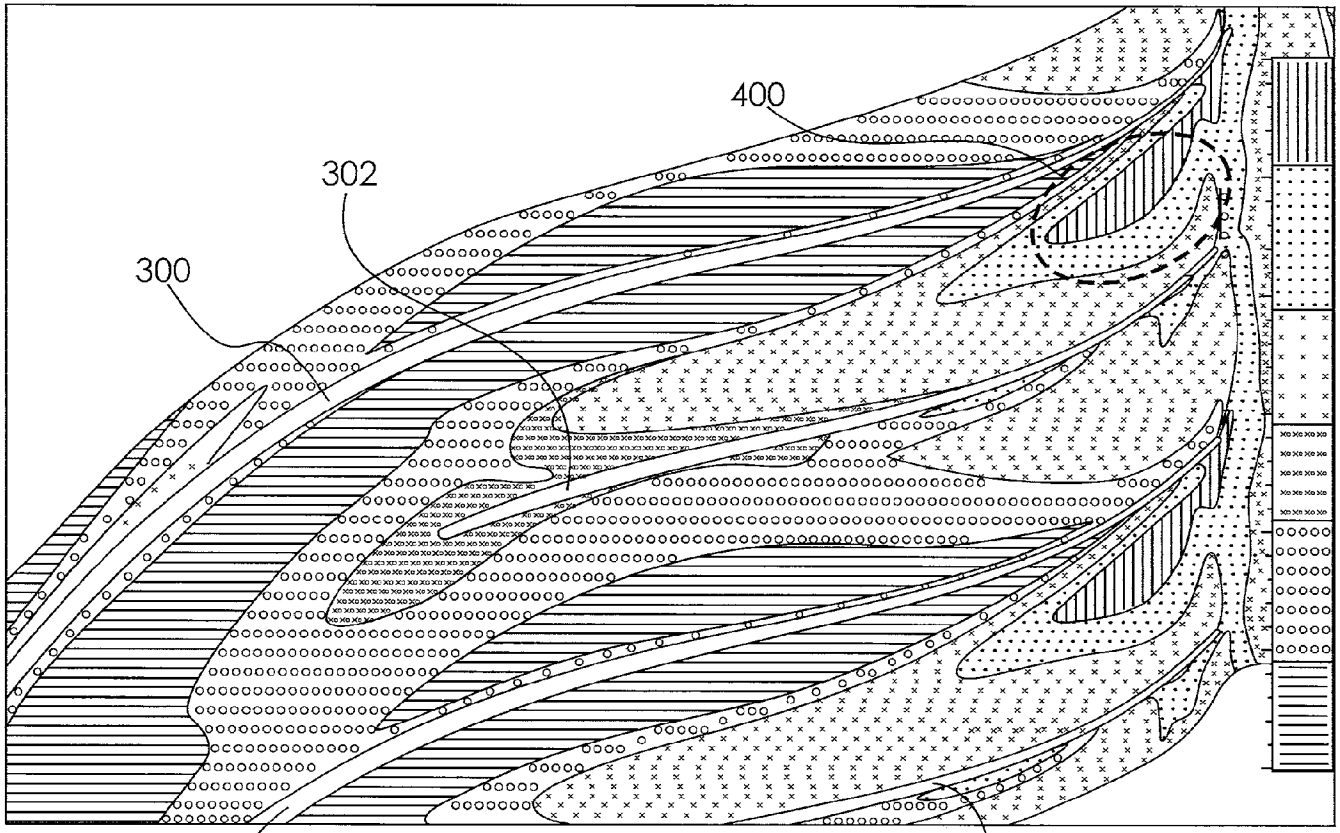
FIG. 4 is a graph of entropy calculated in a computational fluid dynamics simulation for the compressor section of a gas turbine engine of FIG. 3 according to an embodiment.

A computational fluid dynamics (CFD) simulation was performed on a prior art compressor section similar to that shown in FIG. 2 but having a splitter blade exhibiting minimal gap with the flow passage shroud 106. FIG. 3 displays the relative velocity vectors (flow velocity relative to the main blade, which is rotating) calculated in the CFD simulation at 90% span (i.e., a stream surface at a span that is 90% of the span distance from the flow passage hub 104 to the flow passage shroud 106), displayed as theta (y-axis) vs. meridional (x-axis). The main blade location 300 and splitter blade location 302 are shown, with the vectors illustrating the relative velocity and direction of the gas flow at each node point in the simulation mesh. In an ideal situation, the relative velocity vectors will follow the blade separation path, but due to an adverse pressure gradient, flow separation occurs, recirculation zones are created and increased entropy is generated. It can be seen that the suction side of the splitter blade at location 302 exhibits significant flow velocity loss to the point of flow reversal, as indicated in the region 304. This low velocity flow eventually propagates toward the main blade location 300 trailing edge. The same simulation is displayed in FIG. 4 showing the entropy levels, with the recirculation zone 400 generating significant levels of entropy.

Figure 5:
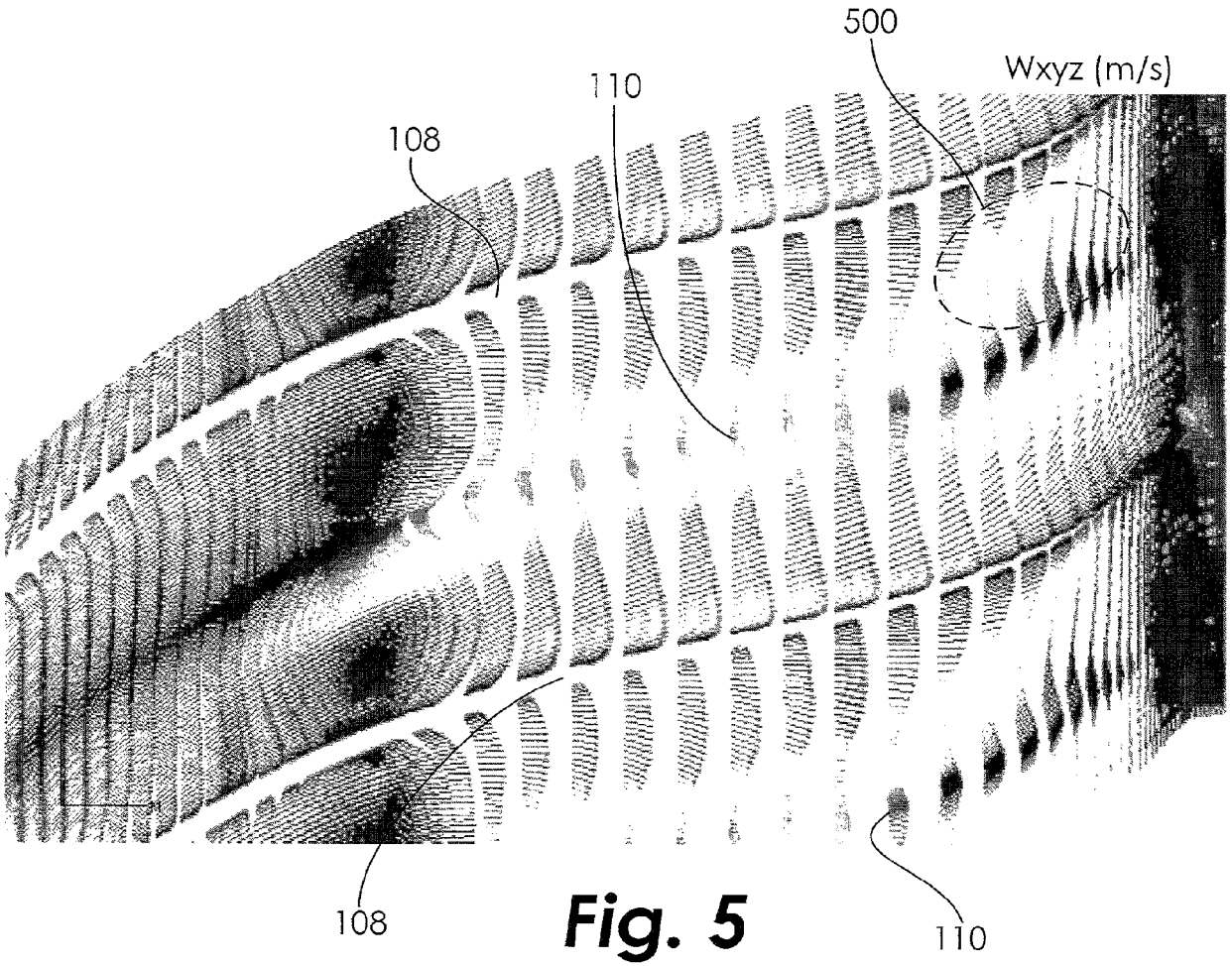
FIG. 5 is a graph of relative velocity vectors (flow velocity relative to the main blade, which is rotating) calculated in a computational fluid dynamics simulation for a compressor section of a gas turbine engine according to the embodiment of FIG. 2.
Figure 6:
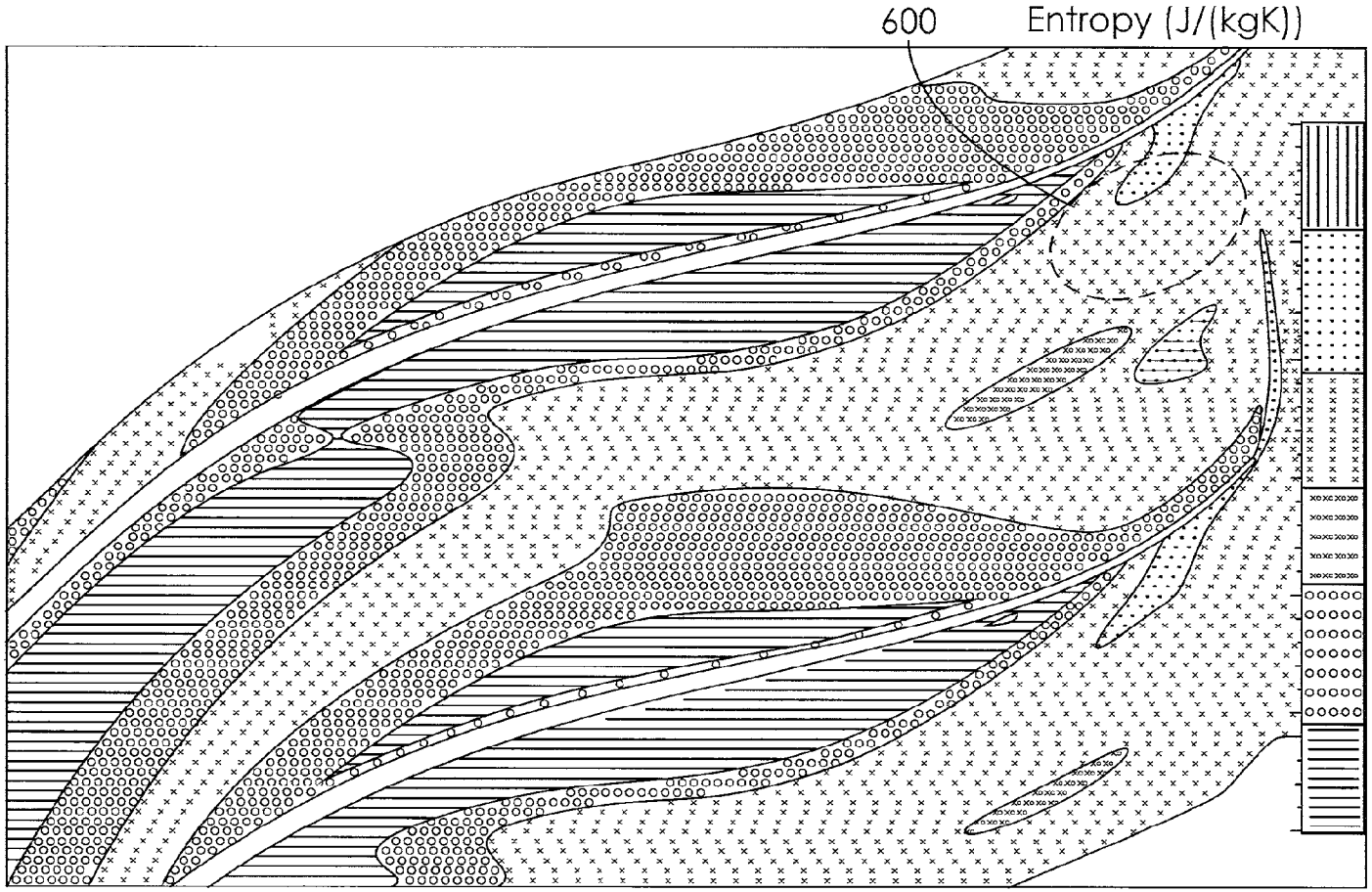
FIG. 6 is a graph of entropy calculated in a computational fluid dynamics simulation for the compressor section of a gas turbine engine according to the embodiment of FIG. 2.

The CFD simulation was next modified to include the variable span splitter blade 110 of FIG. 2. FIG. 5 displays the relative velocity vectors calculated in the CFD simulation at 90% span, displayed as theta (y-axis) vs. meridional (x-axis). The blade 108 and splitter blade 110 locations are shown, with the vectors illustrating the relative velocity and direction of the gas flow at each node point in the simulation mesh. It can be seen that the suction side of the variable span splitter blade 110 exhibits a significantly reduced zone 500 of flow velocity loss. The same simulation is displayed in FIG. 6 showing significantly decreased entropy levels in the area 600 as compared with the uncut splitter blade simulated in FIG. 4.

Figures 7A, 7B:
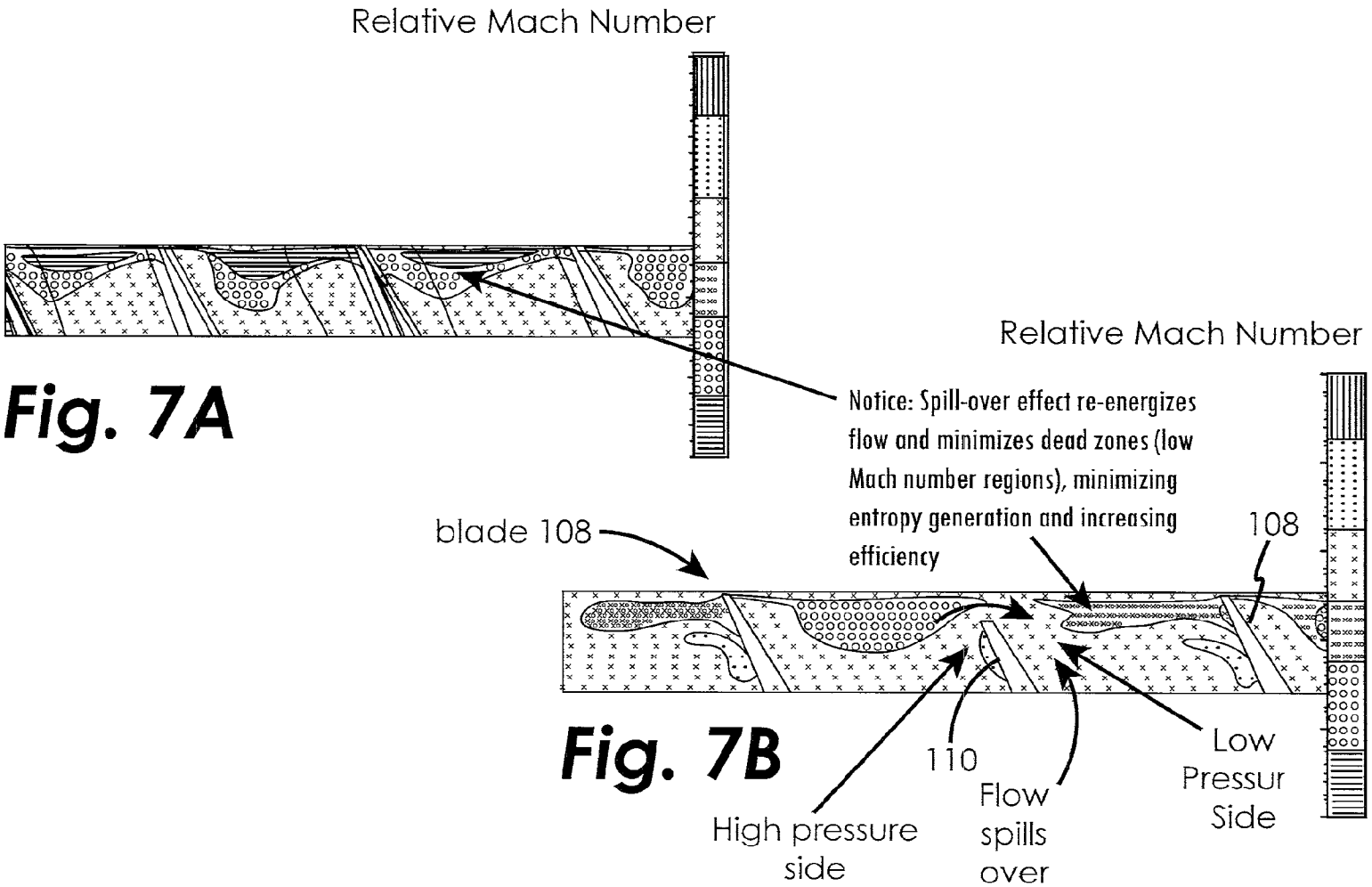
FIG. 7A is a graph of relative Mach number calculated in a computational fluid dynamics simulation for a spanwise section of the geometry shown in FIG. 3.
FIG. 7B is a graph of relative Mach number calculated in a computational fluid dynamics simulation for a spanwise section of the geometry shown in FIG. 5.

FIGS. 7A-B illustrate the relative Mach number when viewed looking radially inward from the location 116 of FIG. 2. In FIG. 7A, the standard geometry (uncut splitter blade) is simulated, showing significant low relative Mach number regions originating from the high pressure side of the main blade and propagating toward the low pressure side of the splitter blade. FIG. 7B illustrates a CFD simulation illustrating the variable span splitter blade 110 of FIG. 2, showing greatly reduced low relative Mach number regions in the flow passage 103, as the flow from the high pressure side of the splitter blade 110 is able to spill over to the low pressure side of the splitter blade 110, re-energizing the flow.

Figure 8:
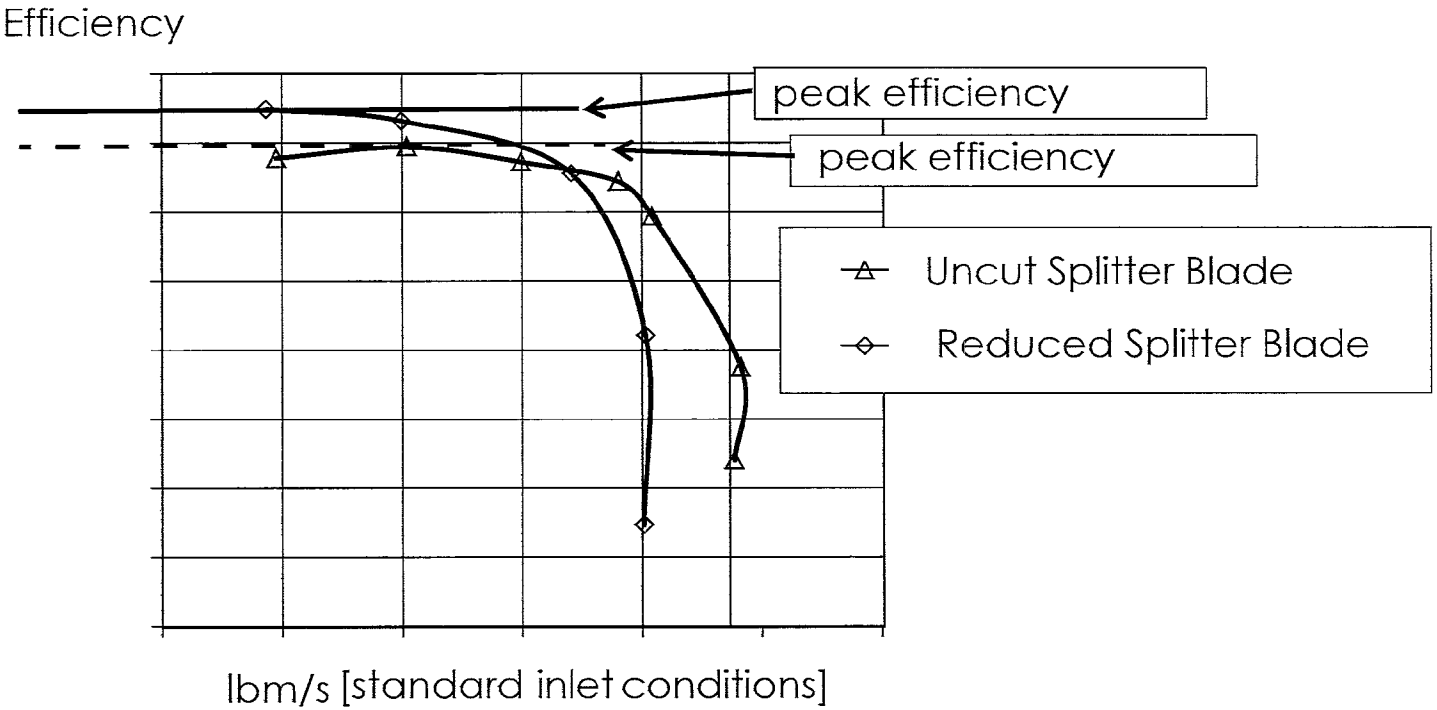
FIG. 8 is a graph of total-total efficiency of the compressor section of a gas turbine engine of FIG. 3 and of the compressor section of a gas turbine engine according to the embodiment of FIG. 2.

FIG. 8 illustrates the total-total efficiency (i.e., the whole compressor, inlet to outlet) compressor map. It can be seen that a gain in efficiency was produced by using the variable span splitter blade 110 versus the standard uncut splitter blade.

It will be appreciated by those skilled in the art from the above disclosure that only one design of a variable span splitter blade is disclosed above, but the present disclosure is not limited to the design disclosed. Similar improvements in performance may be achieved by applying the disclosed principals to diffuser splitter blades, and the use of the phrase "splitter blade" in the present disclosure and the appended claims will encompass both types of blades. The presently disclosed embodiments are intended to encompass any splitter blade in which a spanwise cut along the chord length of the splitter blade is made in order to produce a variable span splitter blade. The exact dimensions of the cut will be dependent upon the specific application, operating conditions of the engine, and the geometries of other components in the engine and their placement relative to the splitter blade.

Thus, while the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed:

1. A compressor for a gas turbine engine, the compressor comprising:

a flow passage shroud;

a flow passage hub;

main blades; and a splitter blade disposed adjacent the flow passage shroud, wherein the splitter blade includes a leading edge, a trailing edge, and a chord length;

wherein a clearance between the splitter blade and the flow passage shroud is variable along the chord length of the splitter blade;

wherein the clearance at the leading edge is between approximately 10% and <100% of a first span between the flow passage hub and the flow passage shroud at the leading edge; and wherein the clearance at the trailing edge is approximately less than 1.5% of a second span between the flow passage hub and the flow passage shroud at the trailing edge.

2. The compressor of claim 1, wherein the clearance between the splitter blade and the flow passage shroud along the chord length of the splitter blade varies linearly.

3. The compressor of claim 1, wherein the clearance between the splitter blade and the flow passage shroud along the chord length of the splitter blade varies nonlinearly.

4. The compressor of claim 1, wherein the clearance between the splitter blade and the flow passage shroud along the chord length of the splitter blade varies linearly in at least one segment and nonlinearly in at least another segment.

5. The compressor of claim 1, wherein the clearance at the leading edge is approximately 50% of the first span between the flow passage hub and the flow passage shroud at the leading edge; and wherein the clearance at the trailing edge is approximately less than 1.5% of the second span between the flow passage hub and the flow passage shroud at the trailing edge.

6. A gas turbine engine, comprising the compressor of claim 1.

7. The gas turbine engine of claim 6, wherein the clearance between the splitter blade and the flow passage shroud along the chord length of the splitter blade varies linearly.

8. The gas turbine engine of claim 6, wherein the clearance between the splitter blade and the flow passage shroud along the chord length of the splitter blade varies nonlinearly.

9. The gas turbine engine of claim 6, wherein the clearance between the splitter blade and the flow passage shroud along the chord length of the splitter blade varies linearly in at least one segment and nonlinearly in at least another segment.

10. The gas turbine engine of claim 6, wherein: the clearance at the leading edge is approximately 50% of the first span between the flow passage hub and the flow passage shroud at the leading edge; and the clearance at the trailing edge is approximately less than 1.5% of the second span between the flow passage hub and the flow passage shroud at the trailing edge.

11. A compressor for a gas turbine engine, the compressor comprising:

a flow passage shroud;

a flow passage hub;

main blades; and a splitter blade disposed adjacent the flow passage shroud, wherein the splitter blade includes a leading edge, a trailing edge, and a chord length;

wherein a clearance between the splitter blade and the flow passage shroud is variable along the chord length of the splitter blade;

wherein the clearance at the leading edge is approximately less than 1.5% of a first span between the flow passage hub and the flow passage shroud at the leading edge; and wherein the clearance at the trailing edge is between approximately 10% and <100% of a second span between the flow passage hub and the flow passage shroud at the trailing edge.

12. A gas turbine engine, comprising the compressor of claim 11.

13. A compressor for a gas turbine engine, the compressor comprising:

a flow passage shroud;

a flow passage hub;

main blades; and a splitter blade disposed adjacent the flow passage shroud, wherein the splitter blade includes a leading edge, a trailing edge, and a chord length;

wherein a clearance between the splitter blade and the flow passage shroud is variable along the chord length of the splitter blade;

wherein the clearance at the leading edge is between approximately 10% and <100% of a first span between the flow passage hub and the flow passage shroud at the leading edge; and wherein the clearance at the trailing edge is between approximately 10% and <100% of a second span between the flow passage hub and the flow passage shroud at the trailing edge.

14. A gas turbine engine, comprising the compressor of claim 13.

* * * * *